US006050290A

United States Patent [19]

Yacobi et al.

[11] Patent Number: 6,050,290

[45] Date of Patent: Apr. 18, 2000

[54] HOSE REEL APPARATUS

[75] Inventors: Michael S. Yacobi, Powell; Thomas W. Parker, Columbus; Lawrence D. Gibbs, Fairfield; Hans Hjort, West Chester, all of Ohio

[73] Assignee: UnionTools, Columbus, Ohio

[21] Appl. No.: 09/105,069

[22] Filed: Jun. 26, 1998

Related U.S. Application Data

[60] Provisional application No. 60/054,560, Aug. 1, 1997.

[51] Int. Cl.[7] ..... B65H 75/34

[52] U.S. Cl. ..... 137/355.2; 242/395.1; 242/396.6; 242/397.3; 254/217

[58] Field of Search ..... 137/355.2, 355.23, 137/355.27; 242/389, 395, 395.1, 396.6, 397.3, 407; 254/217

[56] References Cited

U.S. PATENT DOCUMENTS

| | | | |
|---|---|---|---|
| Re. 32,510 | 9/1987 | Tisbo et al. . | |
| 1,850,676 | 3/1932 | Kieneman . | |
| 1,850,677 | 3/1932 | Kieneman . | |
| 1,875,467 | 9/1932 | Knoerzer et al. | 242/397.3 |
| 2,301,208 | 11/1942 | Gear | 242/297.3 |
| 2,595,655 | 5/1952 | Hannay | 242/397.3 |
| 4,334,670 | 6/1982 | Kawabe | 254/346 |
| 4,512,361 | 4/1985 | Tisbo et al. . | |
| 4,513,772 | 4/1985 | Fisher | 137/355.22 |
| 4,534,384 | 8/1985 | Graham et al. . | |
| 4,777,976 | 10/1988 | Johnson et al. . | |
| 4,974,627 | 12/1990 | Nelson . | |
| 5,381,820 | 1/1995 | Chandler . | |
| 5,386,609 | 2/1995 | Ghio et al. | 137/355.27 |
| 5,404,900 | 4/1995 | Fletchall . | |
| 5,560,390 | 10/1996 | Royds . | |

FOREIGN PATENT DOCUMENTS

| | | |
|---|---|---|
| 41703 78 | 5/1979 | Australia . |
| 798 418 | 5/1936 | France . |
| 2 030 996 | 11/1970 | France . |
| 94 01 104 | 3/1994 | Germany . |
| 61-055068 | 3/1986 | Japan . |
| 61-203079 | 9/1986 | Japan . |
| 534 632 | 3/1973 | Switzerland . |
| WO 94 27904 | 12/1994 | WIPO . |

*Primary Examiner*—John Fox
*Attorney, Agent, or Firm*—Finnegan, Henderson, Farabow, Garrett & Dunner

[57] ABSTRACT

A reel apparatus for storing a flexible member, such as cable or hose, includes a frame assembly, a drum mounted on the frame assembly, a driving shaft coupled to the drum, and a handle mounted on the driving shaft for manually controlling rotation of the drum. The drum may be aligned vertically or horizontally. The apparatus includes means for maintaining the flexible member in substantially taut coiled form along the drum.

10 Claims, 16 Drawing Sheets

HOSE REEL APPARATUS

This appication claim the benefit of U.S. Provisional No. 60/054,560 filed Aug. 1, 1997.

BACKGROUND OF THE INVENTION

1) Field of the Invention

The present invention relates to a reel apparatus. More particularly, the invention pertains to an enclosed reel apparatus including a drum for supporting a flexible member, such as a line, cable or hose, and a mechanism for winding the flexible member on the drum.

2) Description of the Related Art

Various types of reel assemblies for reeling in line and hose are commercially available. A very common assembly includes a horizontally aligned, coaxial drum and crank shaft. The horizontal alignment of the crank shaft requires an operator to bend up and down to rotate the handle. Accordingly, this type of assembly can be cumbersome to operate and may subject the operator to back spasms and fatigue.

Conventional reel assemblies in which a line, hose, or the like is wound on a vertically mounted shaft are faced with other problems. Such assemblies typically have a relatively high center of gravity and, therefore, are prone to being unstable. In addition, the vertical alignment of these assemblies typically causes the line or hose to be loosely supported on the drum of the assembly and to bunch up, thereby making it difficult for the operator to pull out or reel in the line or hose.

Another complication associated only with hose reel assemblies is the lack of access to water except through the hose. Indeed, residential dwellings often times only have a single spigot in the front and rear of the dwelling to hook up the hose to a water supply. In this case, the operator usually is unable to undertake other projects requiring use of water once the hose reel is connected to the spigot.

SUMMARY OF THE INVENTION

To overcome the disadvantages of the prior art and in accordance with the purpose of the invention, as embodied and broadly described herein, a reel apparatus for winding and paying out flexible line material comprises a housing; a drum, on which the line material is wound, mounted within the housing, the drum adapted to be oriented along either a vertical or a horizontal axis, a driving shaft for rotating the drum; a torque transmission mechanism coupling the driving shaft to the drum; and crank handle mounted on an upper portion of the housing, the crank handle being operatively connected to the driving shaft for rotating the driving shaft and the drum to wind line on and off the drum.

Preferably, the crank handle and driving shaft are mounted to rotate about a vertical axis, regardless of the orientation of the drum. When the drum is disposed vertically, it is desirable to provide various mechanisms which prevent the flexible line from coming out of alignment upon the drum.

In addition, it is preferred that the flexible line material is a hollow tube or hose for passing fluid from one end to the other. In this embodiment, the reel apparatus preferably includes an auxiliary spigot on the reel housing to provide fluid access without unplugging the apparatus from the main spigot.

BRIEF DESCRIPTION OF THE DRAWINGS

The accompanying drawings, which are incorporated in and constitute a part of this specification, illustrate presently preferred embodiments of the invention and, together with the general description given above and detailed description given below, serve to explain the principles of the invention.

DESCRIPTION OF THE PREFERRED EMBODIMENT

Reference will now be made in detail to presently preferred embodiments of the invention, examples of which are illustrated in the accompanying drawings. Wherever possible, the same reference numbers will be used throughout the drawings to refer to the same or like parts. For the purposes of this invention, the terms flexible member or line are used in their broadest sense to include, among other things, flexible hose for liquid or gas, electrical cable, and a flexible length of wire, rope, plastic, fiberglass, or plastic encapsulated conductive material.

Figure 1:
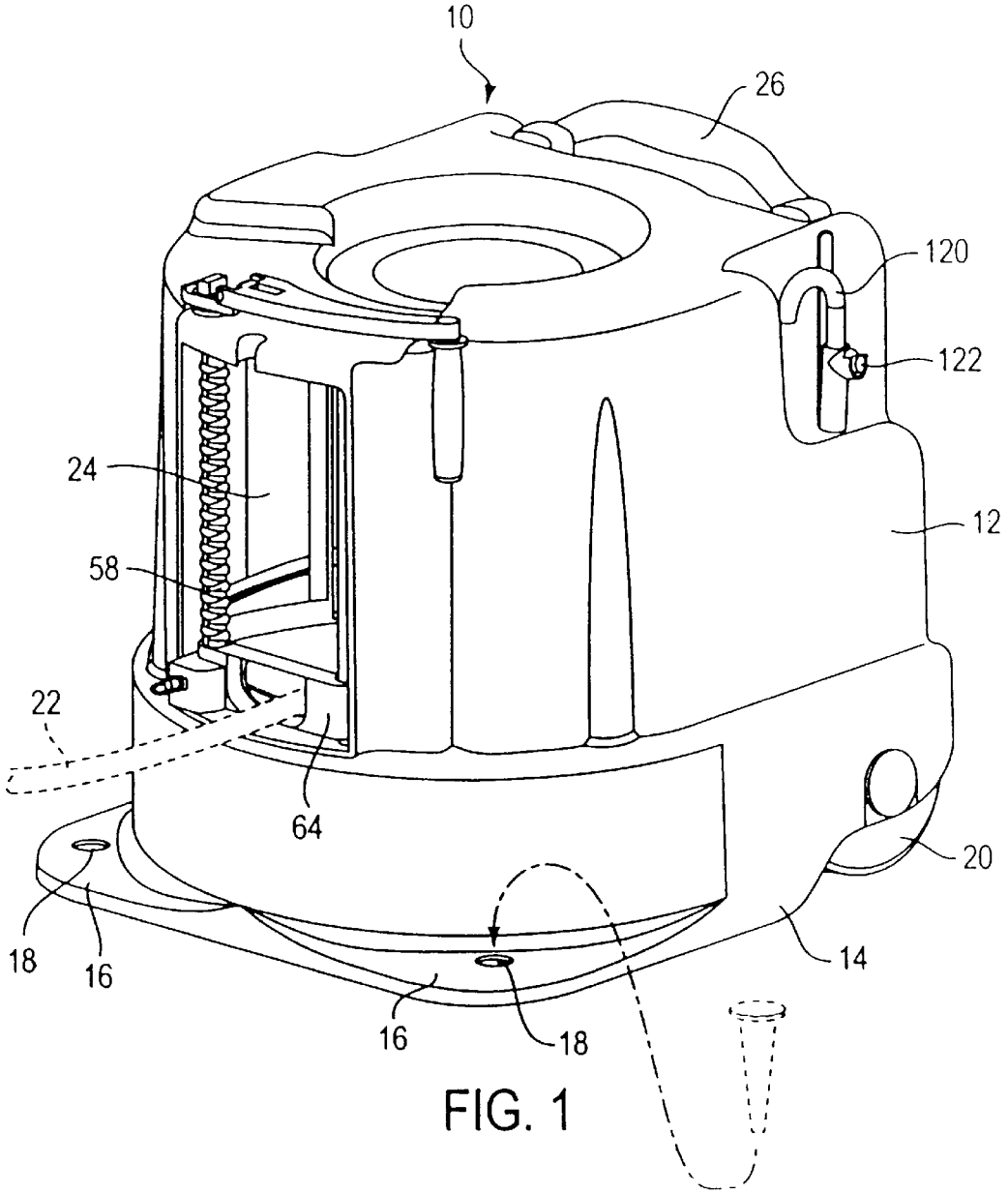
FIG. 1 is a side perspective view of an embodiment of the hose reel apparatus of the present invention.

In accordance with the preferred embodiment of the present invention, as embodied herein and shown generally in FIG. 1, the reel apparatus, which is identified by reference numeral 10, includes an housing or enclosure 12 and a base 14. Preferably, the base 14 is weighted to prevent tipping of the entire apparatus. Alternatively, foot pads 16 or the like may be added to increase stability and allow an operator to stand with his feet on the pads. The foot pads may further include holes 18 so that one or more spikes (shown in dashed lines) may be driven into the ground through the holes 18 to anchor the apparatus at a desired location. The base 14 also includes wheels 20 to enable an operator to transport the apparatus with ease. A molded fender (not shown) may be used for protection and to hide the wheels 20 from view.

As embodied herein and shown generally in FIG. 1, the enclosure 12 for the line reel apparatus provides, among other things, protection from the elements. The enclosure 12 joins the top of the base 14 and surrounds the mechanism of the apparatus. An output line 22 may be reeled in and out of the line reel apparatus 10 through an elongated opening 24 in the enclosure 12. While the line reel apparatus may be formed from any material, the enclosure 12 preferably is integrally formed from a resinous material to add stiffness to the entire apparatus.

As embodied herein and shown generally in FIG. 1, the enclosure 12 includes a telescoping handle 26 above the wheels 20. The telescoping handle 26, shown in FIG. 1, is in a retracted or stowed position. When an operator wishes to move the apparatus, the operator raises the telescoping handle 26 for greater ease of use.

Figure 2:
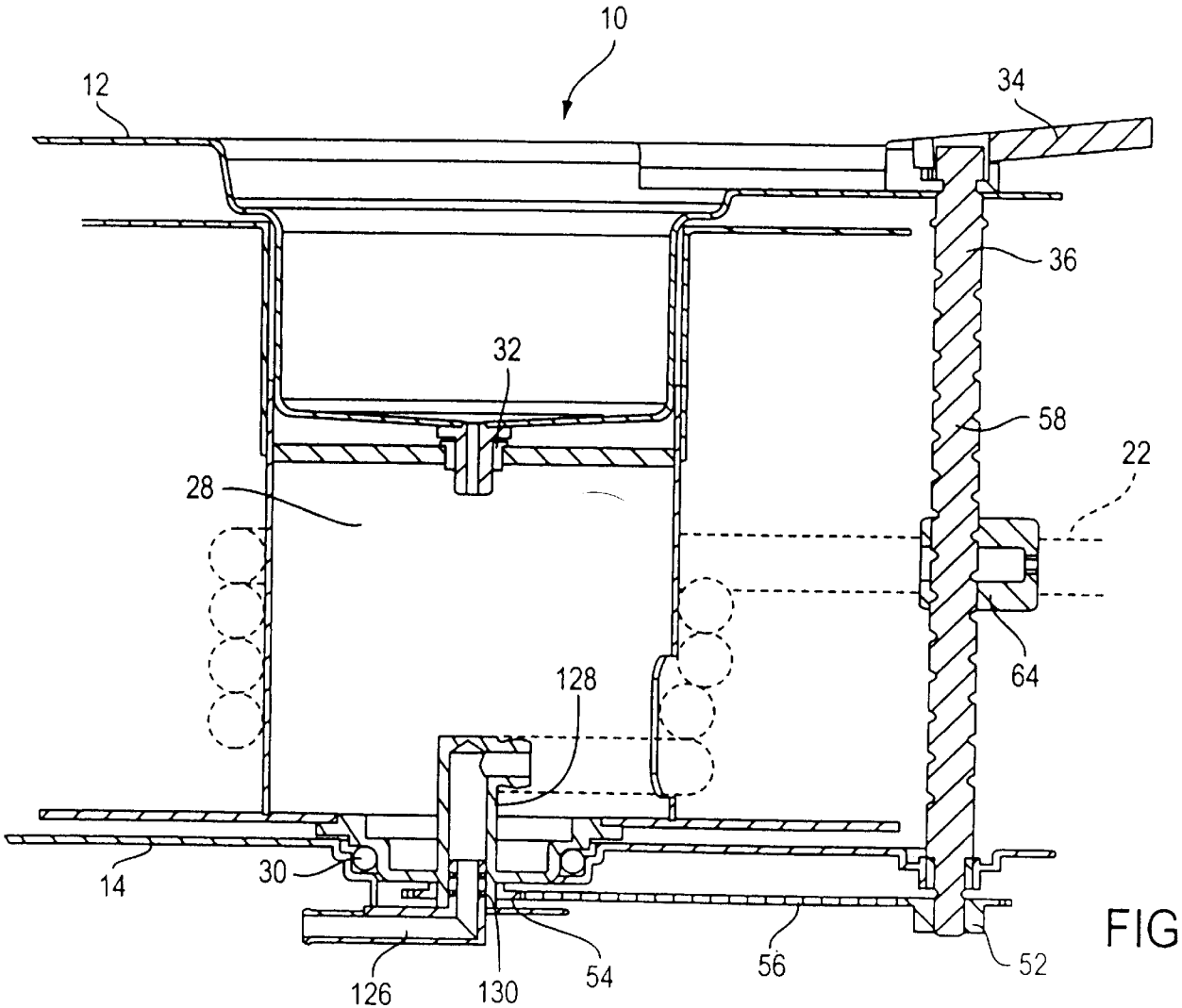
FIG. 2 is a partial sectional view of the hose reel apparatus of FIG. 1.
Figure 19:
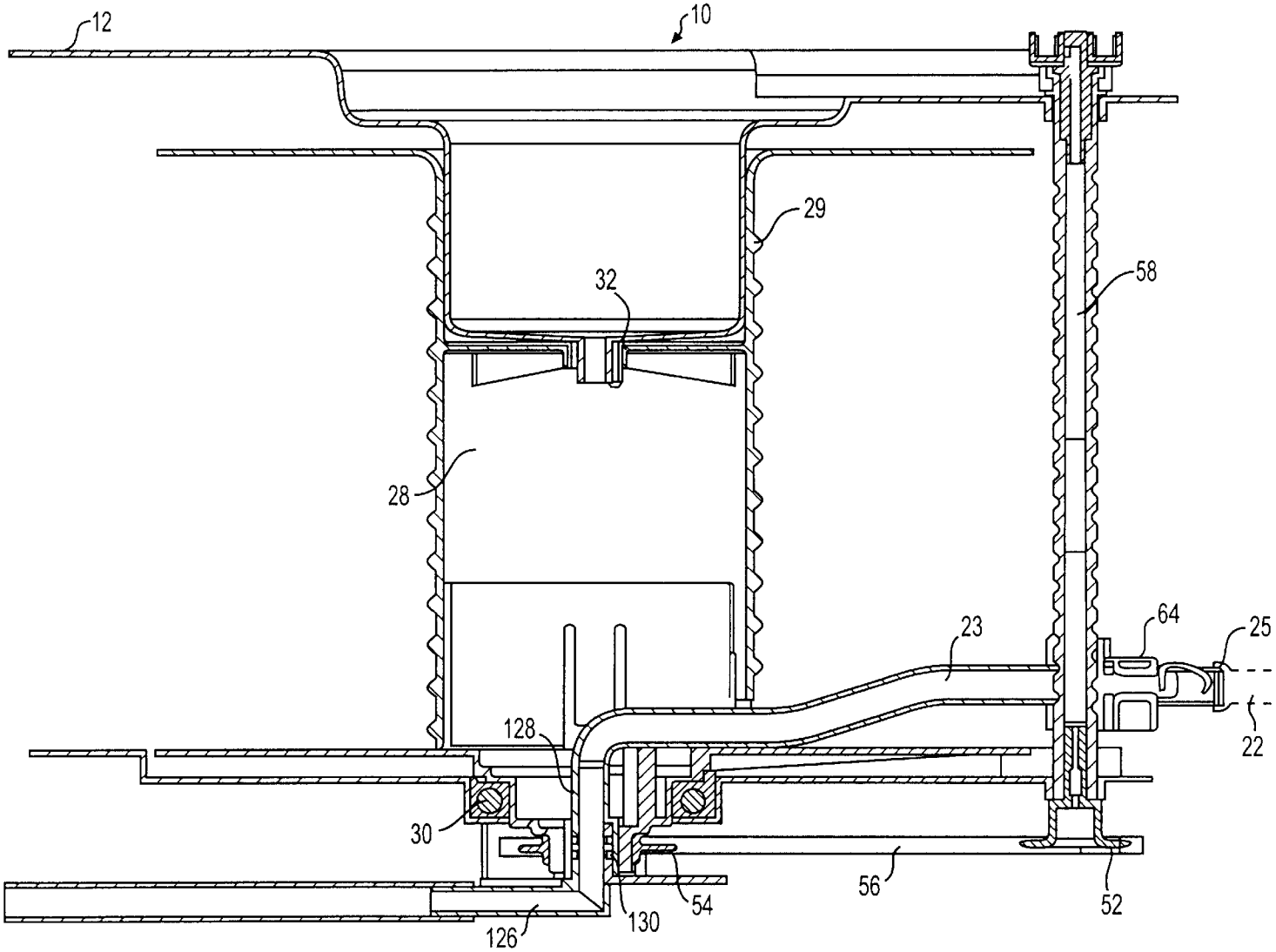
FIG. 19 is a partial sectional view of the hose reel apparatus of FIG. 1.

As embodied herein, and shown generally in FIG. 2, the apparatus includes a drum 28 for supporting the output line 22. Preferably, the enclosure 12 and the base 14 support the drum 28 such that the axis of the drum 28 is oriented vertically. Bearings 30 or the like may rotatably support the drum 28 on the base 14. A bushing 32 rotatably couples the drum 28 to the enclosure 12. Preferably, as shown in FIG. 19, the drum 28 has ribs 29 to hold a first layer of line wound onto the drum 28 in alignment.

In accordance with the present invention, the line reel apparatus includes a rotation mechanism. As embodied herein and shown generally in FIGS. 2 and 3, the rotation mechanism for the line reel apparatus 10 includes a crank handle 34, a driving shaft 36, and a torque transmission device coupling the drum 28 and the driving shaft 36. The driving shaft 36 is supported by the enclosure 12 and the base 14 in parallel with the axis of the drum 28. As shown generally in FIG. 4, a pivot joint 38 may be provided to join the crank handle 34 to the top of the driving shaft 36.

As embodied herein, and shown generally in FIGS. 1–4, the crank handle 34 allows an operator of the line reel apparatus to reel the output line 22 onto the drum 28. The preferred vertical orientation of the driving shaft 36 enables the operator to rotate the crank handle 34 without bending up and down, thus reducing fatigue. The pivot joint 38 between the crank handle 34 and the top of the driving shaft 36 allows the operator to engage or disengage the crank handle 34 with the top of the driving shaft 36. When the crank handle 34 is in the disengaged position, it may be stowed to one side of the top of the enclosure 12, as shown in FIG. 1. In the engaged position, as shown in FIG. 2, the crank handle 34 allows the operator of the apparatus to rotate the driving shaft 36 in a first direction.

In accordance with the present invention, the reel apparatus includes elements for maintaining the line in a substantially taught coiled form, such that the line is distributed evenly along the drum, is not bunched up, or susceptible to slippage along the length of the drum. As embodied herein and shown generally in FIGS. 4 and 13–15, the means for maintaining the line in substantially taught alignment includes a ratcheting mechanism preferably between the crank handle 34 and the driving shaft 36. In the ratcheting mechanism illustrated in FIG. 4, the driving shaft includes a ratcheting gear 40 at its top. An internal slot 44 in the crank handle 34 opens into the aperture 42. The slot 44 slidably receives a spring-biased pawl 46. An external slot 48 extends from the internal slot 44 to the outside of the crank handle 34. A member 50 fixed to the pawl 46 slides along the external slot 48. The ends of the external slot 48 define stops for the member 50 and limit movement of the pawl 46 within the internal slot 44 to a distance approximately defined by the ratcheting gear tooth depth.

Figure 13:
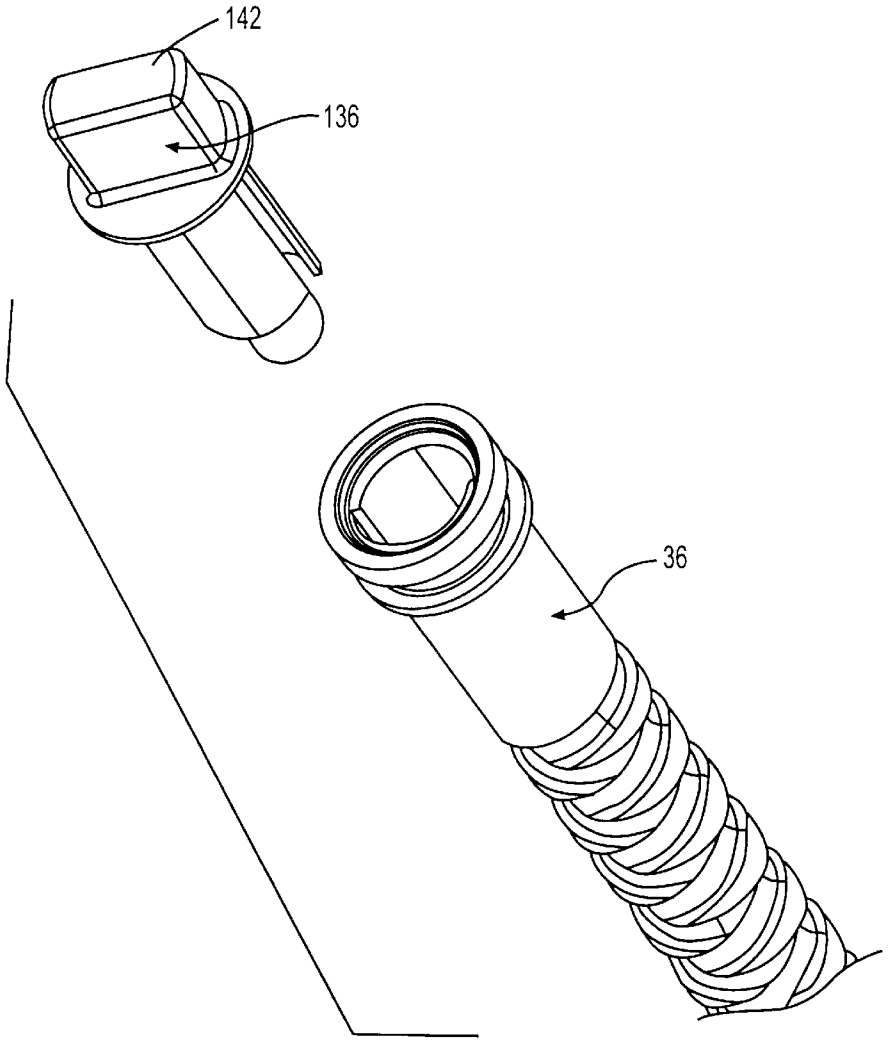
FIG. 13 is an exploded view of a presently preferred pawl mechanism.
Figure 14:
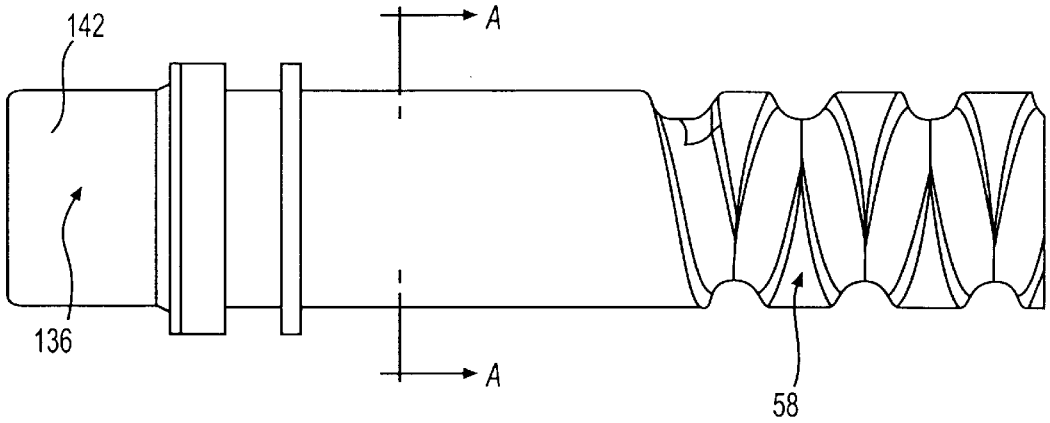
FIG. 14 is a side view of the pawl mechanism of FIG. 13.
Figure 15:
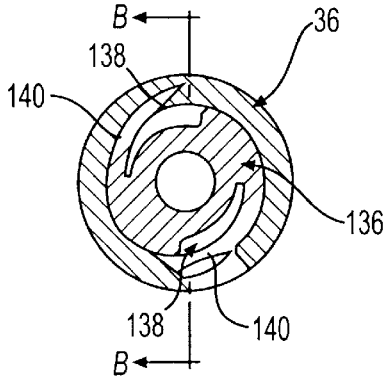
FIG. 15 is a top sectional view take n along line A—A in FIG. 14.

In a second embodiment of the ratcheting mechanism, as generally illustrated in FIGS. 13–15, a spring biased pawl includes a stud pawl 136 rotatably carried in an end of the driving shaft 36. The inside surface of the driving shaft 36 has notches 138. The stud pawl 136 further includes outwardly biased cut out portions 140 for engaging the notches 138. The stud pawl 136 includes a stud 142 for engaging the crank handle 34 in the engaged position.

As embodied herein, the ratcheting mechanism prevents use of the handle 34 for rotating the driving shaft 36 in a second direction, opposite from the first direction. It may be desirable to prevent rotation in the second direction using the crank handle 34 to prevent the output line 22 from becoming loose upon the drum 28. Other mechanisms, discussed below, further prevent the output line 22 from loosening on the drum 28. If the output line 22 becomes loose upon the drum 28, it can slide down and out of alignment on the drum 28 making it more difficult to subsequently reel the output line 22 in or out of the apparatus.

In accordance with the present invention, means are provided for transmitting torque between the driving shaft 36 and the drum 28. As embodied herein and shown generally in FIG. 2, the torque transmission means may include sprockets 52 and 54 fixed to the bottom ends of the driving shaft 36 and the drum 28, and a chain drive 56 engaging the two sprockets 52 and 54. The sprocket 52 may be joined to the inside of the driving shaft by a spline connection (not shown). Rotation of the driving shaft 36 or the drum 28 causes the other of the driving shaft or the drum to rotate. When the operator turns the crank handle 34 in the first direction, both the driving shaft 36 and the drum 28 rotate in the first direction. Rotational energy is transferred between the driving shaft 36 and the drum 28 by the chain drive 56. The output line is reeled into the apparatus by rotation of the drum.

Figure 3:
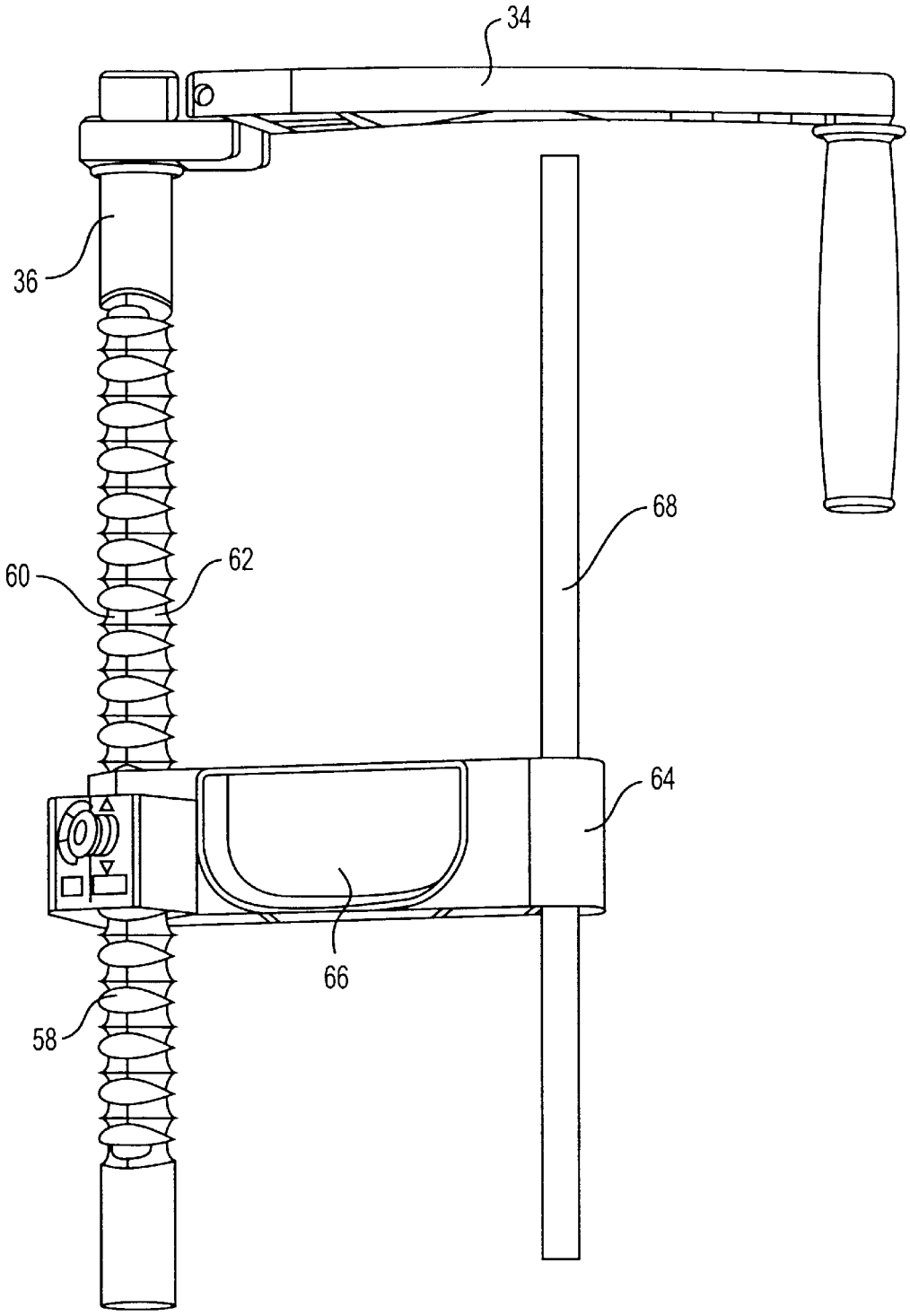
FIG. 3 is a front, elevational view of a portion of the rotation mechanism of FIG. 1.
Figure 4:
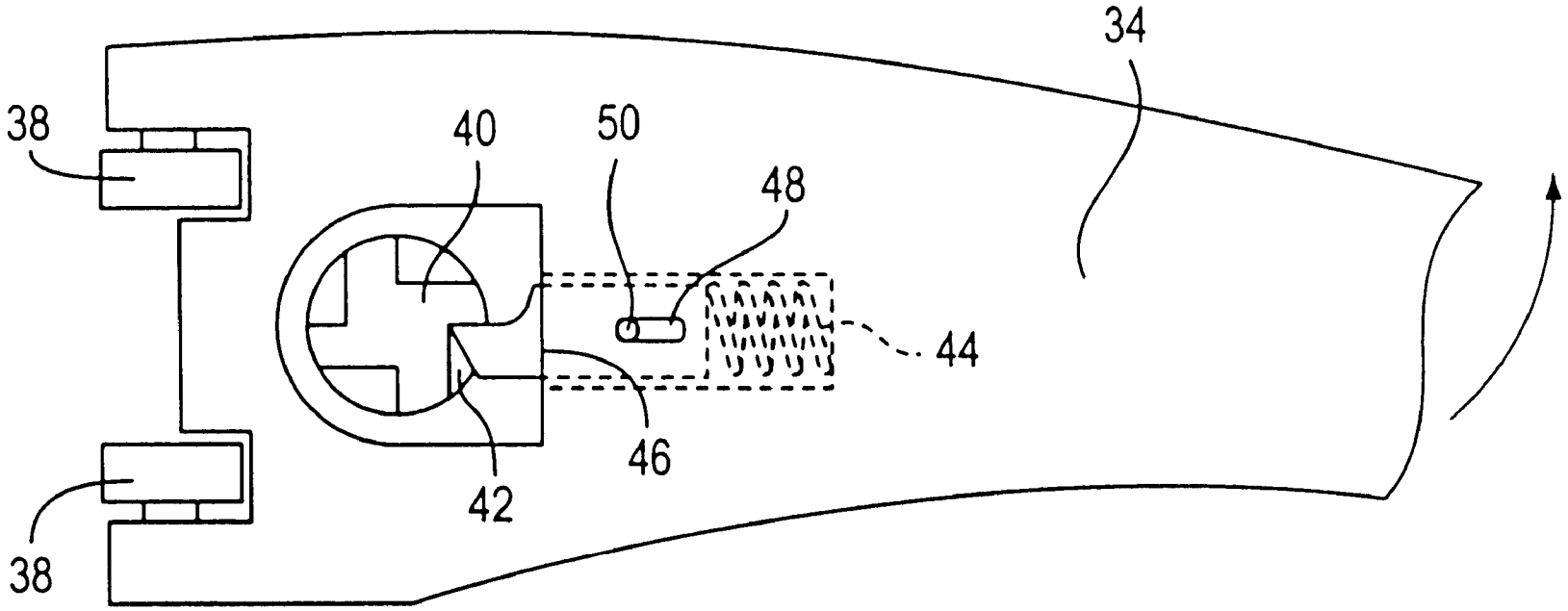
FIG. 4 is a top plan view of the crank handle of FIG. 2.

As embodied herein and shown generally in FIGS. 1–3, the driving shaft 36 further includes a reversing screw 58 along the length of the driving shaft corresponding approximately to an axial length of the drum 28. The reversing screw 58 includes two grooves 60 and 62 connected at both ends of the reversing screw and crisscrossing along the length of the reversing screw. One of the two grooves is a right-hand groove and the other is a left-hand groove.

Figure 12:
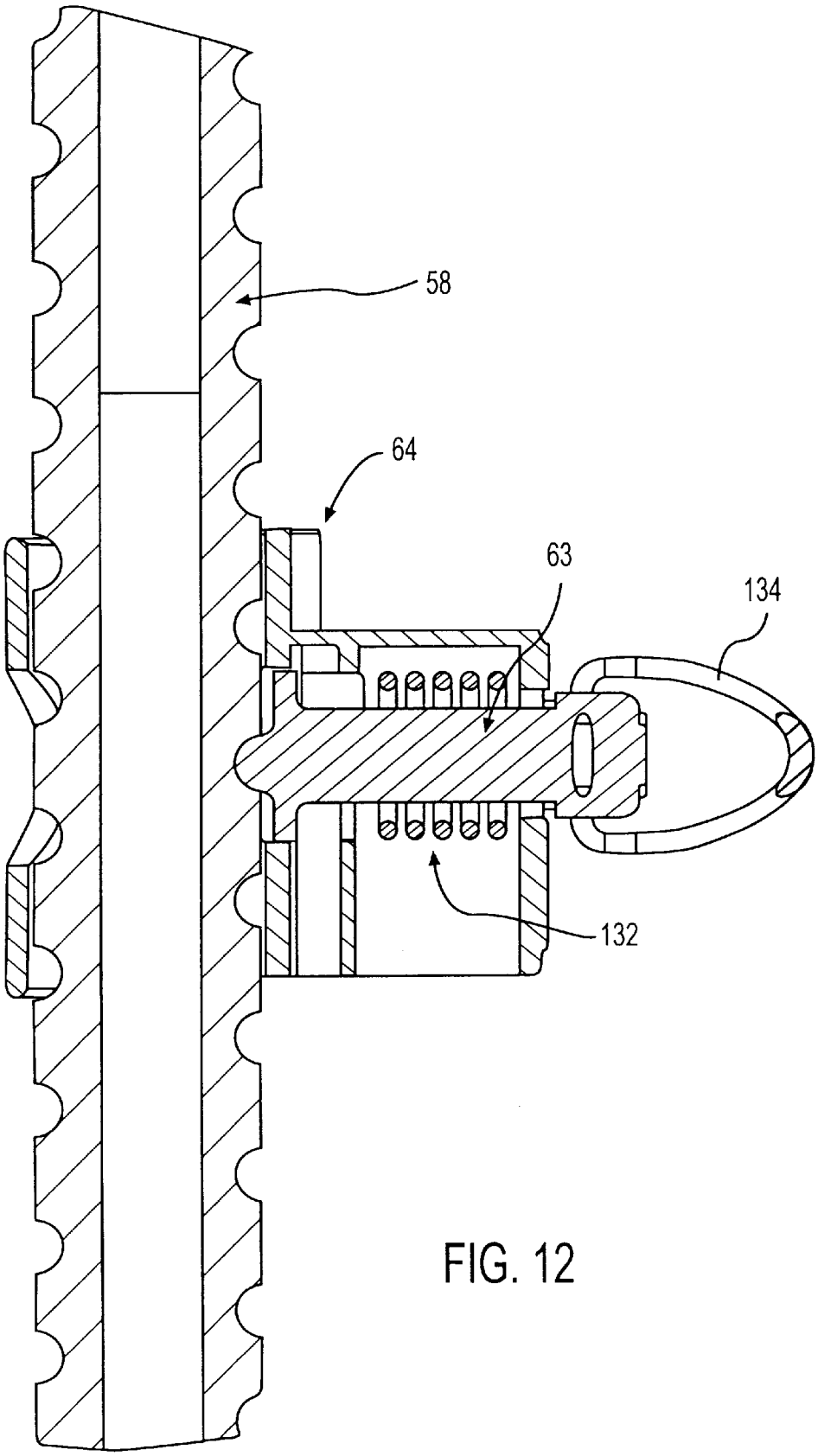
FIG. 12 is a sectional view of the driving shaft and guide member of FIG. 3.

As embodied herein and shown principally in FIGS. 2, 3, and 12, a follower 63 in a guide member 64 engages at least one of the grooves 60 or 62 of the reversing screw 58. A spring 132 biases the follower 63 towards the driving shaft and into one of the grooves 60 or 62. The follower 63 can be disengaged from the grooves by pulling on pull ring 134 so that the position of the guide member can be adjusted. The output line 22 feeds through an opening 66 in the guide member. A support column 68 constrains the guide member 64 to translational motion along the axis of the reversing screw 58.

The guide member 64 causes the output line 22 to wind neatly around the drum 28. Rotation of the reversing screw 58 in either the first or second direction causes the guide member 64 to travel up and down the reversing screw. When the guide member 64 reaches either end of the reversing screw 58, it reverses the direction it travels along the screw. When the crank handle 34 is rotated in the first direction, the driving shaft 36 and the drum 28 also rotate in the first direction. The guide member 64 neatly feeds the output line 22 onto the drum 28 such that the output line does not bunch up. When the output line 22 is pulled out of the line reel apparatus 10, the drum 28 and the driving shaft 36 rotate in the second direction. The guide member 64 once again moves up and down the driving shaft 36 to maintain the output line 22 in alignment on the drum 28, and hence is another element which contributes to maintaining the line in a substantially taught coiled form along the drum 28.

Figure 5:
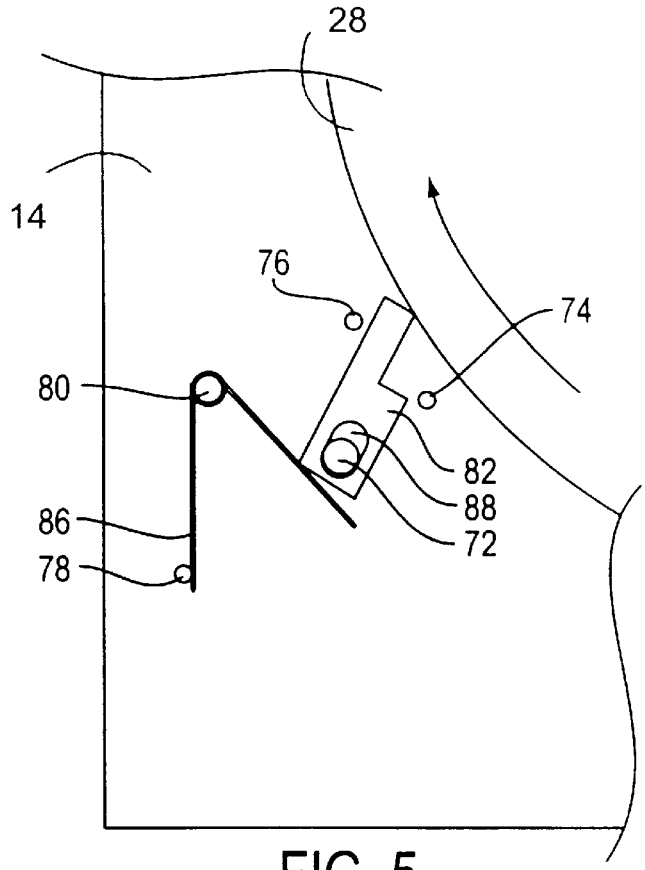
FIG. 5 is a view of a presently preferred drag-mechanism of the present invention.
Figure 6:
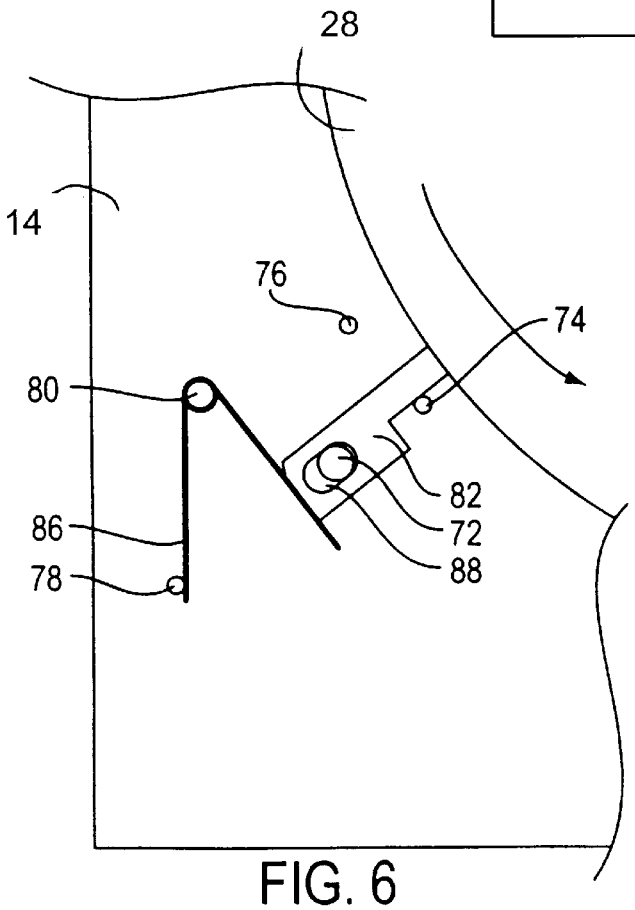
FIG. 6 is a view of a presently preferred drag-mechanism of the present invention.

In accordance with the present invention, as embodied herein and shown in FIGS. 5 and 6, tension in the line is also provided by a drag mechanism. The drag mechanism comprises five pins 72, 74, 76, 78, and 80 projecting from the base 14, a brake block 82 resting on the base 14 adjacent a lower flange 84 of the drum 28, and a spring 86. One of the pins 72 is received in a slot 88 of the brake block to constrain the translational movement of the brake block 82. Second and third pins 74 and 76 constrain rotational movement of the brake block 82. Fourth and fifth pins 78 and 80 support the spring 86 to press the brake block 82 into contact with the lower flange of the drum.

The drag mechanism allows for free movement of the drum when the output line 22 is pulled into the line reel apparatus 10 and wound onto the drum 28, as shown in FIG. 5. However, as shown in FIG. 6, when the operator pulls the output line 22 out of the apparatus, the drag mechanism presses against the lower flange of the drum 28. This increases the tension in the output line 22 such that the output line does not loosen and slide down upon the drum 28.

Figure 7:
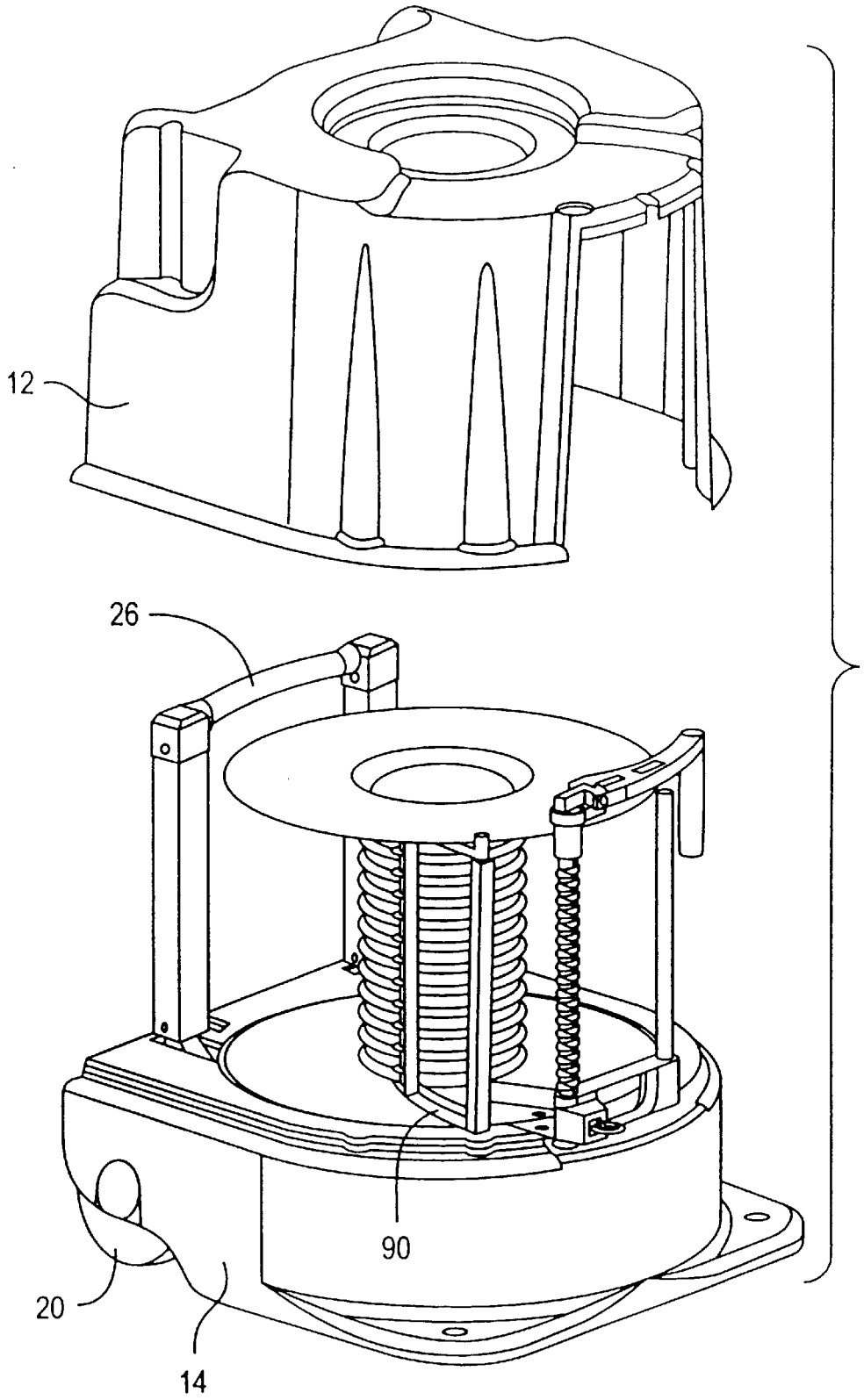
FIG. 7 is an exploded view of the hose reel apparatus of FIG. 1.
Figure 9:
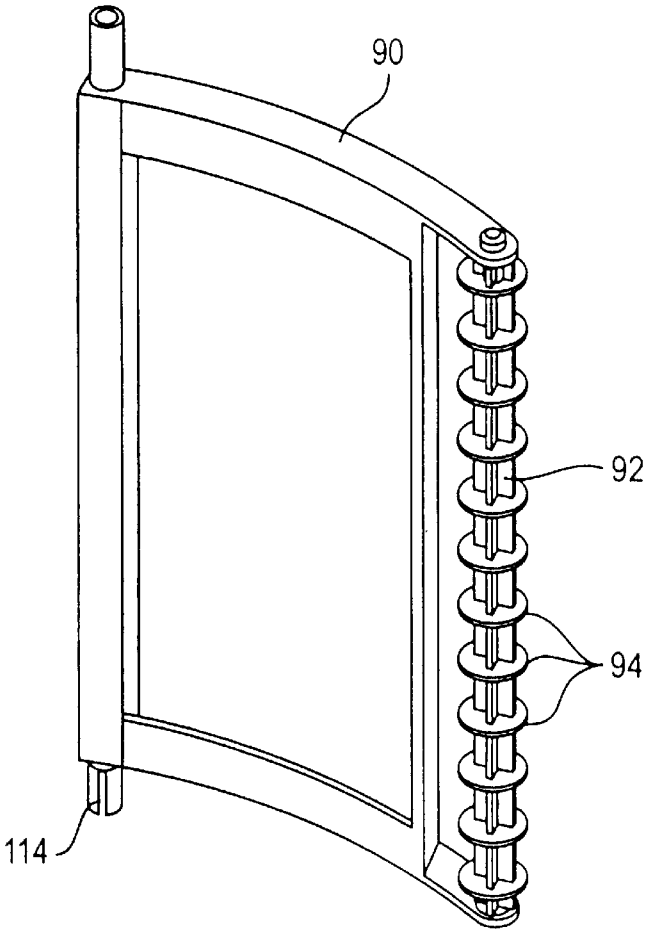
FIG. 9 is a view of the coil-guide roller of FIG. 7.
Figure 8:
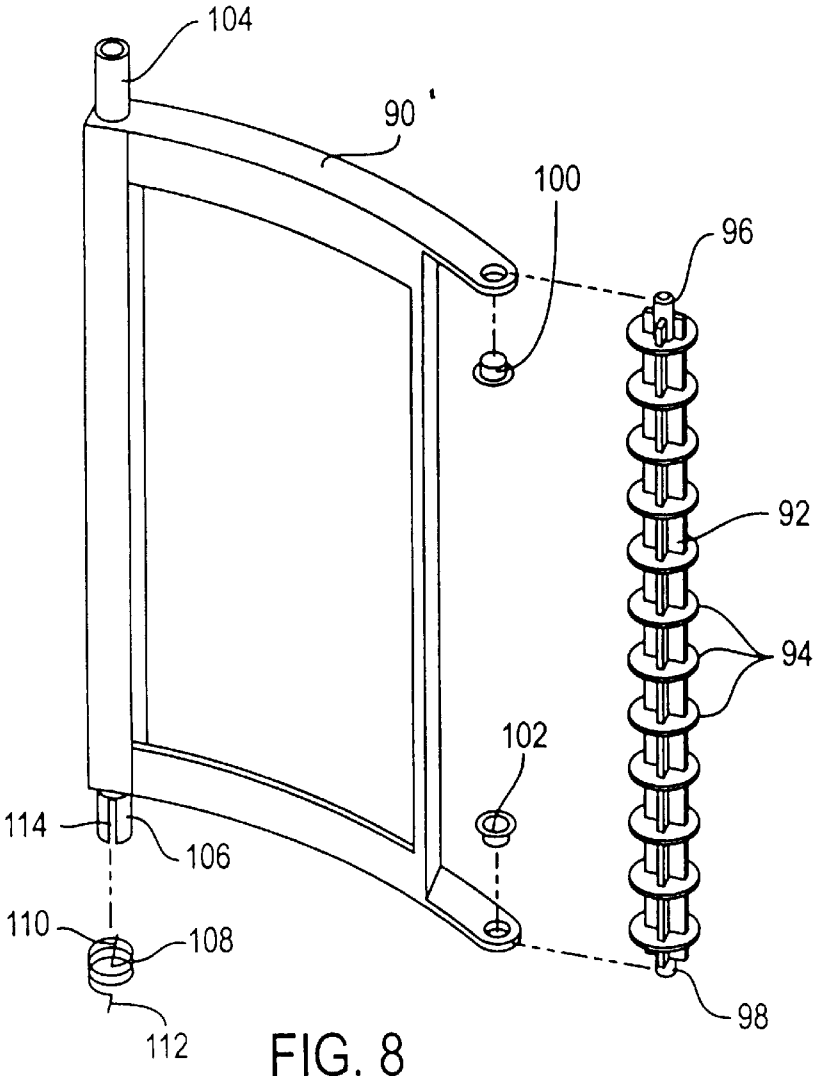
FIG. 8 is an exploded view of the coil-guide roller of FIG. 7.
Figure 10:
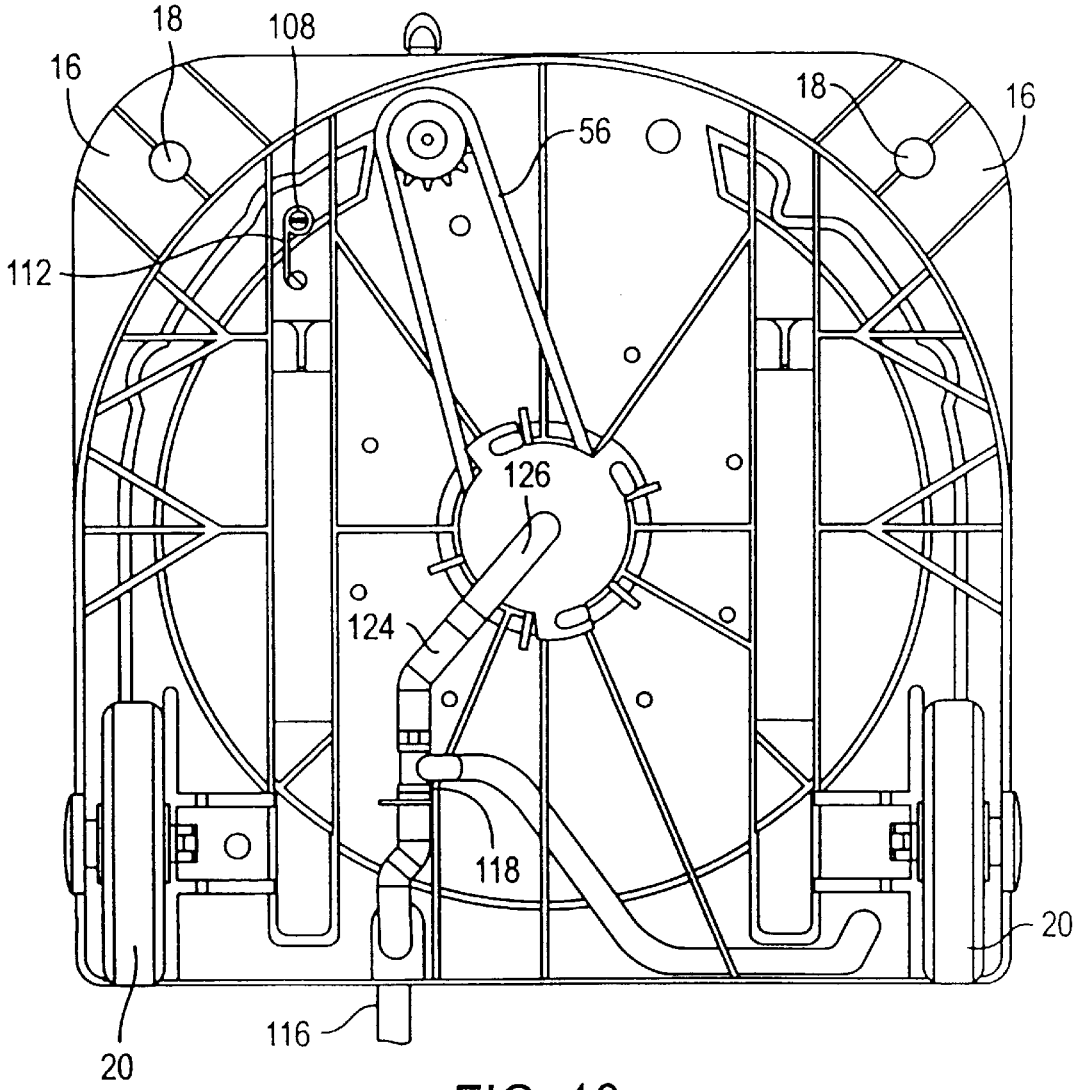
FIG. 10 is a bottom view of the hose reel apparatus of the present invention.

As embodied herein, and as shown in FIGS. 7–9, the present invention may further include a coil guide arm 90 and a coil guide roller 92. The coil guide roller 92 includes combs 94 to maintain the alignment of the output line 22 on the drum 28. Upper and lower roller pivots 96 and 98 sit in bushings 100 and 102 and allow the coil guide roller 92 to rotate with respect to the coil guide arm 90. The coil guard arm 90 includes upper and lower arm pivots 104 and 106, fitting into pivot holes in the enclosure 12 and the base 14, respectively. A rotational axis, extending between the upper and lower arm pivots 104 and 106 of the coil guard arm 90, is spaced in parallel relative to the drum axis. As shown in FIG. 7, the arm pivots 104 and 106 sit outside the periphery of the flange of the drum 28. A torsion spring 108 fits around the lower arm pivot 106 and includes an upper inwardly bent member 110 and a lower outwardly oriented member 112. The inwardly bent member 110 sits in a slot 114. The outwardly oriented member is fixed to the bottom of the base 14, as illustrated in FIG. 10. The torsion spring 108 biases the coil guide arm 90 inwards towards the drum 28. The coil guide arm 90 and the coil guide roller 92 further prevent the output line 22 from sliding down on the drum 28.

As embodied herein, and as illustrated in FIG. 19, preferably the reel apparatus is provided with a drum line 23 having a connector end 25 at one of its ends for joining the output line 22 with the drum line 23. The drum hose line is long enough to extend from the base of the drum 28 to just beyond the guide member 64 at its lowest position, as illustrated in FIG. 19, so that when a customer attaches his own output line 22 to the connector end 25, he does not have to reach into or dismantle the reel apparatus 10 to connect the output line 22 to the base.

As embodied herein and as illustrated in FIGS. 2 and 10, the present invention includes pipe connections. A leader hose 116 connects the line reel apparatus with an outside spigot (not shown), i.e., water source, to provide water to the apparatus. At its other end, the leader hose 116 connects with a first branch of a T-shaped connector 118. The pipe connector 118 directs incoming water in two directions through second and third branches. Some of the water entering the pipe connector 118 exits through its second branch to a rotatable, auxiliary spigot 120 (See FIG. 1). The rotatable, auxiliary spigot 120 includes a manually operated valve 122. The pipe connector 118 directs the rest of the water through its third branch up through the bottom of the drum 28 to the hose 22. A connection pipe 124 extends between the third branch of the pipe connector and a water pipe 126 at the bottom of the drum 28.

Figure 11:
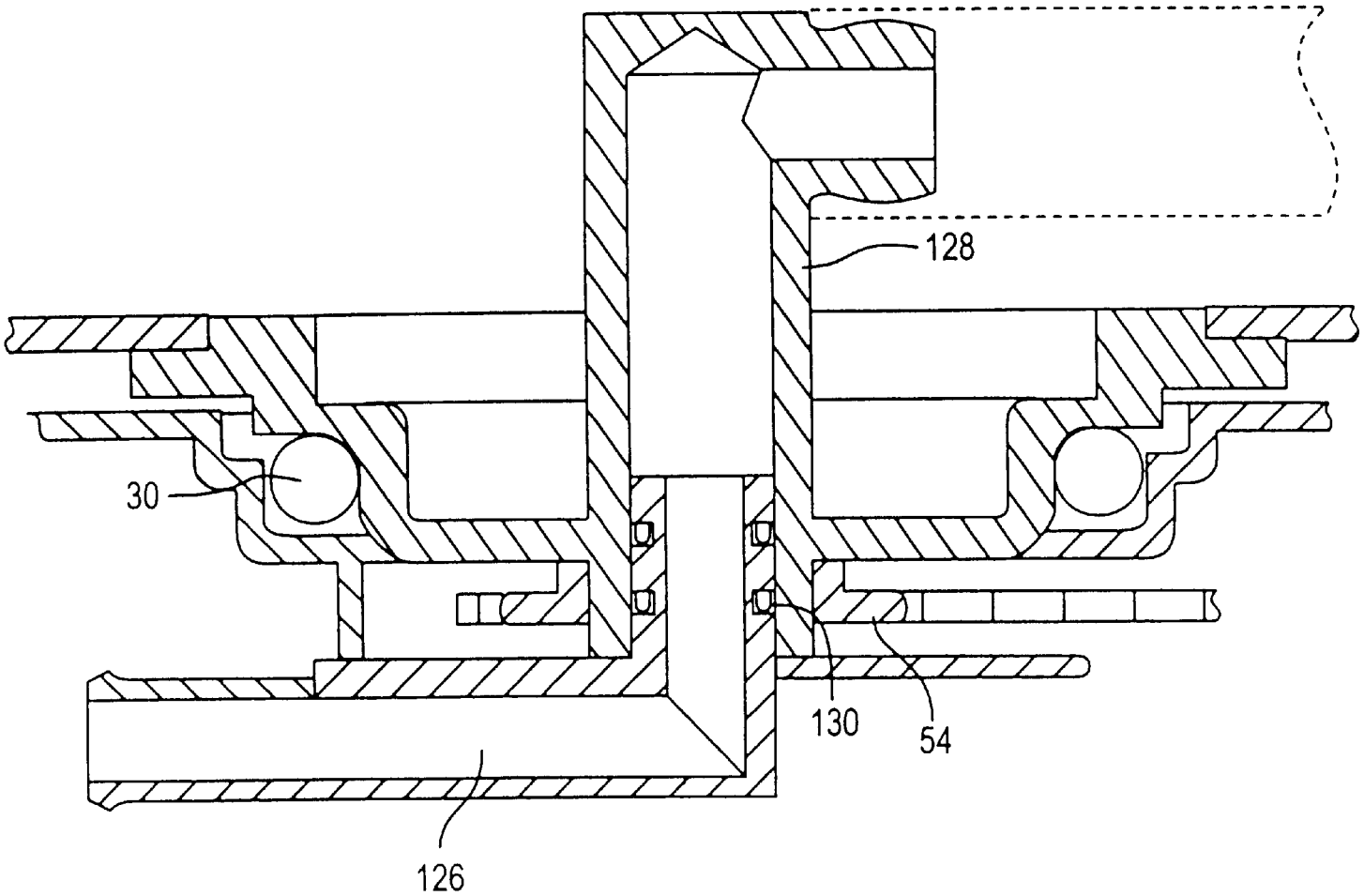
FIG. 11 is an enlarged view of the piping of FIG. 2.

As embodied herein and as illustrated in FIGS. 2,11, and 19, the water pipe 126 rotatably joins with a feed pipe 128. The feed pipe 128 is fixed to and supported by the drum 28 so that it rotates with the drum 28. The output line 22 is attachable to the open end of the feed pipe 128. Alternatively, if the reel apparatus is provided with a drum hose, as illustrated in FIG. 19, the output hose 22 is attachable to the connector end 25 of the drum hose 23. The opposite end of the feed pipe 128 makes a female connection with the water pipe 126. Because bearings 30 carry all of the load of the drum 28 on the base 14, there is no loading between the feed and the water pipe. Consequently, the water pipe 126 and the feed pipe 128 are free to rotate with respect to one another. Preferably, ring-shaped seals 130 having U-shaped cross-sections prevent water from leaking at the joint. Alternatively, other types of seals may be used, such as O-ring seals.

Figure 16:
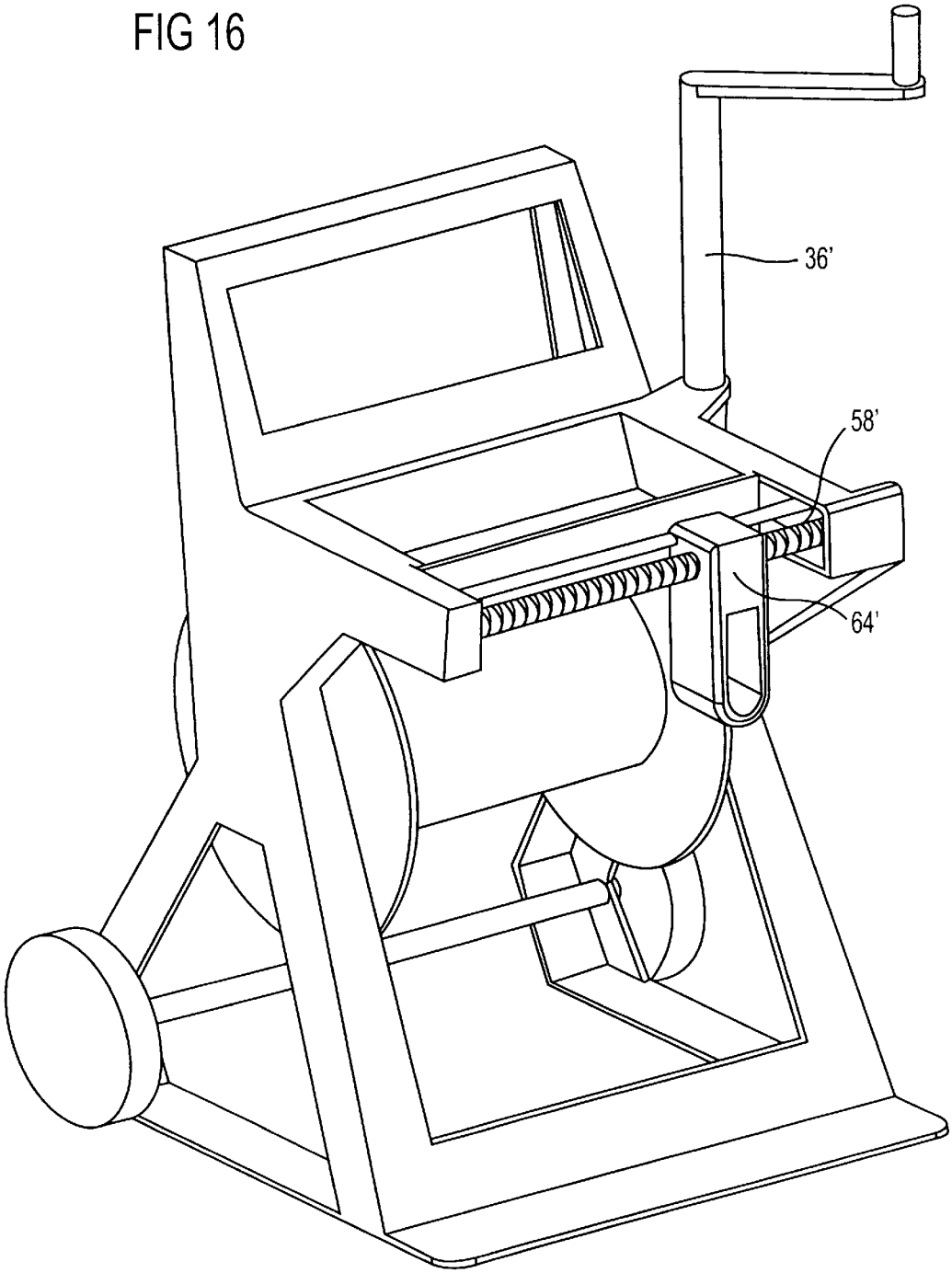
FIG. 16 is a perspective view of the front of another embodiment of the invention.
Figure 17:
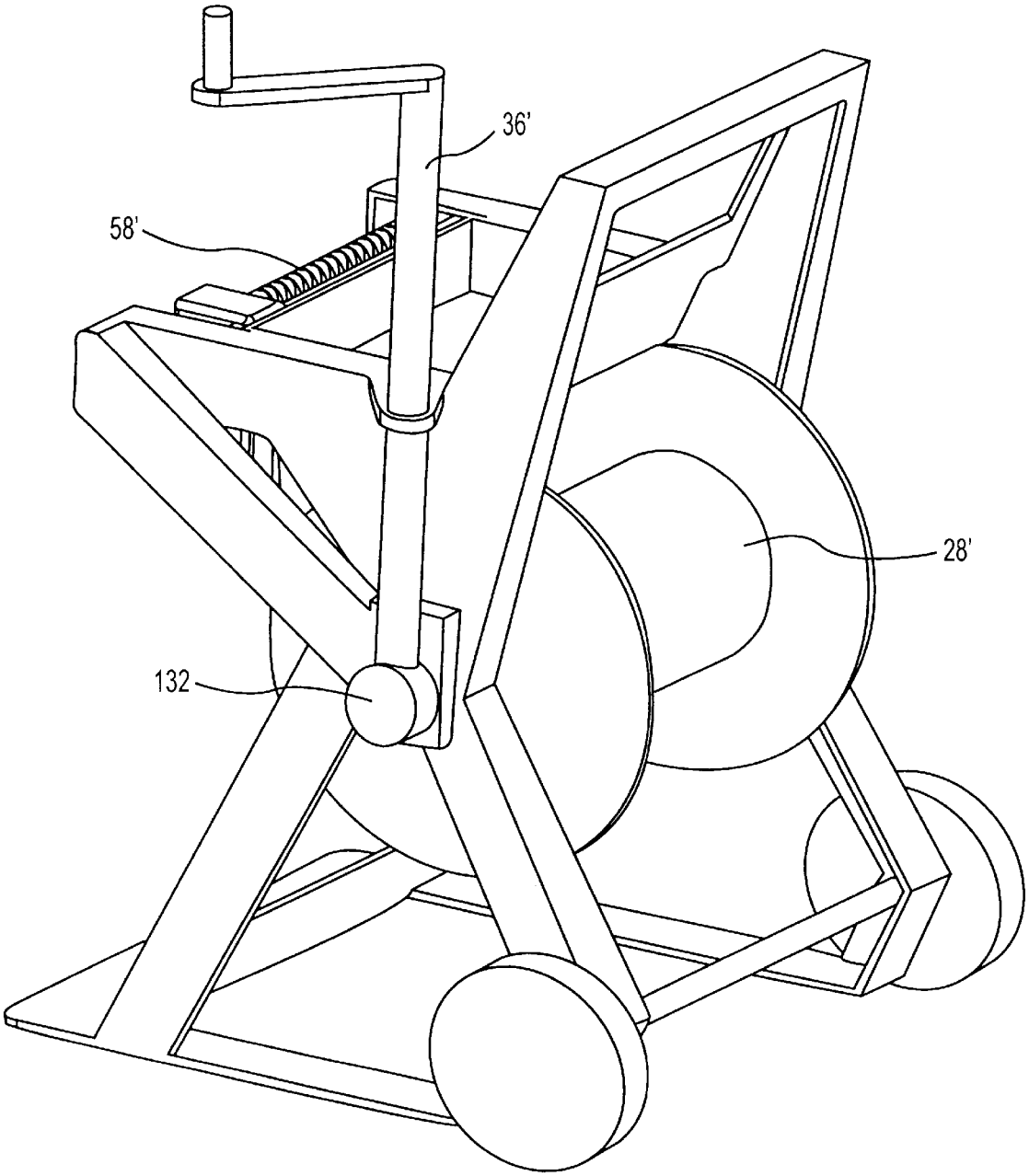
FIG. 17 is a perspective view of the rear of the embodiment of the invention shown in FIG. 16.
Figure 18:
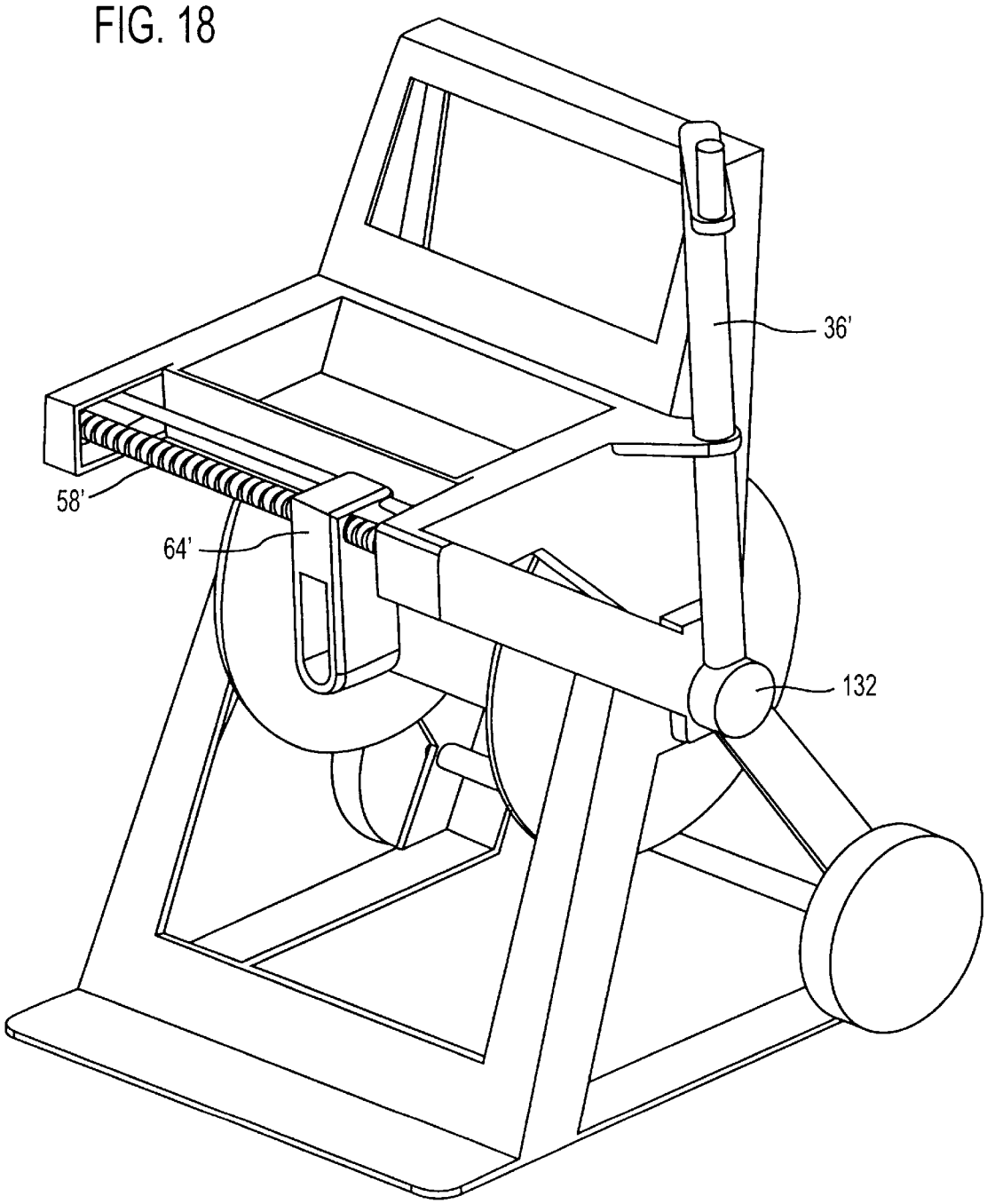
FIG. 18 is another perspective view of the front of the embodiment of the invention shown in FIG. 16.

In a further embodiment of the invention, as shown generally in FIGS. 16–18, the drum 28' has a horizontally oriented axis. The driving shaft 36' transmits torque to the drum through a drive mechanism 132. Torque is also transmitted to the reversing screw 58' through torque transmission means. As in the first embodiment, the torque transmission means may be a sprocket and chain assembly. The reversing screw 58' and the guide member 64' operate in much the same manner as the vertically oriented drum.

In operation, the reel apparatus of the present invention is operated by withdrawing the line 22 by pulling it from the line reel apparatus. When the operator is finished using the line 22, he may reel the line 22 back into the assembly using the crank handle 34 to rotate the drum 28. Because the crank handle 34 rotates about a vertical axis and is disposed generally above the drum, the operator does not need to bend up and down to crank the line into the apparatus and is thus less likely to experience back spasms and fatigue.

Various mechanisms, such as ribs on the drum, a ratcheting mechanism, a drag mechanism, and/or a coil guide, may be utilized to prevent the line 22 from coming out of alignment on the drum 28. Because the line 22 is kept in alignment, it winds on and off of the drum 28 smoothly. The ratcheting mechanism may be provided between the crank handle 34 and the driving shaft 36 to prevent use of the handle 34 for rotating the drum 28 in a direction opposite from the winding on direction. If the drum 28 were rotated in this second, opposite direction, the rotation of the drum 28 would push the line 22 off of the drum 28. The line 22 would then become loose upon the drum 28. The drag mechanism allows for free movement of the drum 28 when the output line 22 is pulled into the line reel apparatus and wound onto the drum 28. However, when the operator pulls the output line 22 out of the apparatus, the drag mechanism presses against the lower flange of the drum 28, thus increasing the tension in the output line 22. The coil guide arm 90 and roller 92 are biased against the drum 28 and push the line 22 onto the drum. The drum 28 may also be ribbed to hold the first layer of line wound onto the drum 28 in alignment.

If the line reel apparatus is used to store a flexible hose, the apparatus may be provided with various piping mechanisms and the leader hose 116 to supply water or some other fluid which an operator wishes to distribute. The leader hose 116 is attached to a supply spigot. It is preferable to provide the apparatus with an auxiliary spigot 120 to provide access to the water or fluid without disconnecting the leader hose 116 from the supply spigot. This enables an operator to access the water or fluid from either a remote end of the output hose or the auxiliary spigot 120.

Without departing from the scope and spirit of the invention, other embodiments and variations of the invention will be apparent to those skilled in the art from consideration of the specification and practice of the invention disclosed herein. For example, instead of sprockets, pulleys may be fixed to the bottom of the driving shaft and the drum. A drive belt, engaging the pulleys, may also be utilized to transfer rotational energy between the driving shaft 36 and the drum 28. Thus, it is intended that the specification and examples be considered as exemplary only, with a true scope and spirit of the invention being indicated by the following claims.

What is claimed is:

1. A reel apparatus for storing a flexible member, comprising:

a frame assembly having a housing;

a rotatable drum mounted on the frame assembly and enclosed within the housing for supporting the flexible member in a substantially taut coiled form, the drum being adapted for rotation about a first axis;

a driving shaft coupled to the drum, the driving shaft being mounted on the frame assembly for rotation about a second axis;

a handle connected to the driving shaft for manually rotating the driving shaft about the second axis;

means for maintaining the flexible member in the substantially taut coiled form when the flexible member is coiled along the drum; and a flexible drum line fixed to the frame assembly at a base of the rotatable drum and being long enough to extend out of the housing such that the flexible member can be attached to the drum line outside of the housing.

2. The reel apparatus of claim 1, wherein the means for maintaining the flexible member in the substantially taut coiled form comprises a traveling guide member.

3. The reel apparatus as defined in claim 2, wherein the traveling guide member assembly comprises a receiving screw on the drive shaft, and a guide member operatively connected to the receiving screw.

4. The reel apparatus as defined in claim 3, wherein the traveling guide member assembly further includes a support column attached to the frame assembly and extending parallel to the drive shaft.

5. The reel apparatus as defined in claim 4, wherein the guide member extends between and is operatively connected to the support column and the receiving screw of the drive shaft.

6. The reel apparatus as defined in claim 3, wherein the receiving screw has grooves and the guide member includes a follower having a protrusion that rides within the grooves.

7. The reel apparatus as defined in claim 6, wherein the protrusion is spring biased into the grooves.

8. The reel apparatus as defined in claim 7, further including a release mechanism in the guide member for removing the protrusion from the grooves.

9. The reel apparatus as defined in claim 3, wherein the receiving screw has left-handed grooves and right handed grooves.

10. A reel apparatus for storing a flexible member, comprising:

a frame assembly;

a rotatable drum mounted on the frame assembly for supporting the flexible member in a substantially taut coiled form, the drum being adapted for rotation about a first axis;

a driving shaft coupled to the drum, the driving shaft being mounted on the frame assembly for rotation about a second axis;

a handle connected to the driving shaft for manually rotating the driving shaft about the second axis; and means for maintaining the flexible member in the substantially taut coiled form when the flexible member is coiled along the drum, wherein the means for maintaining the flexible member in the substantially taut coiled form includes a ratcheting mechanism for releasably connecting the handle to the driving shaft, whereby the ratcheting mechanism provides for rotation of the drive shaft only in a first direction to wind the flexible member onto the drum.

* * * * *